US007490549B2

(12) United States Patent
Nauche

(10) Patent No.: US 7,490,549 B2
(45) Date of Patent: Feb. 17, 2009

(54) MAIL PROCESSING MACHINE COMPRISING A MODULE OPTIMISING FRANKING AND METHOD FOR OPTIMISING FRANKING

(75) Inventor: Gilles Nauche, Ville d'Avray (FR)

(73) Assignee: SECAP (Groupe Pitney Bowes) S.A.S., La Plaine St. Denis (FR)

( * ) Notice: Subject to any disclaimer, the term of this patent is extended or adjusted under 35 U.S.C. 154(b) by 715 days.

(21) Appl. No.: 10/310,733

(22) Filed: Dec. 5, 2002

(65) Prior Publication Data

US 2003/0136282 A1 Jul. 24, 2003

Related U.S. Application Data

(63) Continuation of application No. PCT/FR01/01455, filed on May 14, 2001.

(30) Foreign Application Priority Data

Jun. 5, 2000 (FR) ..... 00 07152

(51) Int. Cl.
*G07B 17/02* (2006.01)
*B41L 47/56* (2006.01)

(52) U.S. Cl. ..... 101/484; 705/406; 705/407; 400/70

(58) Field of Classification Search ..... 101/91, 101/232, 479, 212, 488, 693, 424, 484; 400/70; 347/4; 705/407, 406; 700/100, 221
See application file for complete search history.

(56) References Cited

U.S. PATENT DOCUMENTS 4,639,873 A * 1/1987 Baggarly et al. ..... 705/406
4,800,505 A * 1/1989 Axelrod et al. ..... 700/221
4,817,042 A * 3/1989 Pintsov ..... 700/220
5,072,401 A * 12/1991 Sansone et al. ..... 700/219
5,177,687 A * 1/1993 Baggarly et al. ..... 705/406
5,243,908 A * 9/1993 Gilham ..... 101/232
5,264,665 A * 11/1993 Delfer, III ..... 177/25.15
5,283,752 A * 2/1994 Gombault et al. ..... 700/221
5,538,232 A * 7/1996 Long ..... 270/1.03
5,628,249 A * 5/1997 Cordery et al. ..... 101/91
5,655,089 A * 8/1997 Bucci ..... 705/40
5,684,706 A * 11/1997 Harman et al. ..... 700/95
5,726,894 A * 3/1998 Sansone ..... 705/408
5,802,503 A * 9/1998 Sansone ..... 705/401
5,873,073 A * 2/1999 Bresnan et al. ..... 705/410
5,983,209 A * 11/1999 Kara ..... 705/407
6,026,385 A * 2/2000 Harvey et al. ..... 705/408

(Continued)

FOREIGN PATENT DOCUMENTS

DE 37 25 153 2/1988

(Continued)

*Primary Examiner*—Leslie J Evanisko
(74) *Attorney, Agent, or Firm*—George M. Macdonald; Angelo N. Chaclas

(57) ABSTRACT

A mail processing machine is described including a recto-verso printer adapted to receive data to be printed and to produce printed documents based on the data, the documents being designed to be enclosed and franked; the processing machine includes a system upstream of the printer to optimize the process for franking the cover by recto-verso printing the documents at will in case a value related to the weight of said documents exceeds a postal threshold.

19 Claims, 5 Drawing Sheets

U.S. PATENT DOCUMENTS

| | | | | |
|---|---|---|---|---|
| 6,030,132 | A * | 2/2000 | Harman et al. | 400/62 |
| 6,296,405 | B1 * | 10/2001 | Brewington et al. | 400/188 |
| 6,299,365 | B1 * | 10/2001 | Harris et al. | 400/188 |
| 6,496,810 | B1 * | 12/2002 | Pollard et al. | 705/407 |
| 6,513,804 | B2 * | 2/2003 | Baumann et al. | 271/264 |
| 2002/0159814 | A1 * | 10/2002 | Frederic | 400/693 |

FOREIGN PATENT DOCUMENTS

| | | |
|---|---|---|
| EP | 0 153 813 | 9/1985 |
| EP | 0 621 563 | 10/1994 |
| EP | 1 001 382 | 5/2000 |
| FR | 2799690 | 4/2002 |
| WO | WO 01/95258 | 12/2001 |

* cited by examiner

MAIL PROCESSING MACHINE COMPRISING A MODULE OPTIMISING FRANKING AND METHOD FOR OPTIMISING FRANKING

CROSS REFERENCE TO RELATED APPLICATIONS

This application is a continuation of International Patent Application No. PCT/FR01/01455 filed May 14, 2001, which designates the United States and claims priority of pending Application No. FR 0007152, filed Jun. 5, 2000.

BACKGROUND

1. Field of the Invention

The invention concerns a machine and a method for selectively optimizing the franking of envelopes provided in an office machine comprising a printer that receives data to be printed from a data provider such as a computer, and connected for instance to an automatic inserting machine by a connector module such as is described in patent application No. FR 2799690.

2. Background Art

Patent application FR 2799690 describes a connection between a printer and an envelope machine.

BRIEF SUMMARY OF THE INVENTION

The aim of the invention is to allow, at the operator's discretion, economies in paper use, optimization of the franking process, and optimization of the insertion capacities of the enclosing/inserting machine.

The invention fulfills this aim thanks to a mail processing machine, comprising a printer adapted to receive data to be printed and to produce printed documents based on said data, said documents being designed to be enclosed and franked, characterized in that the printer is capable of recto-verso printing the documents and in that the processing machine comprises means upstream of the printer to optimize the process for franking the cover by recto-verso printing the documents at will in case a value related to the weight of said documents exceeds a postal threshold.

The invention also has the aim of providing a method for handling mail comprising a stage for printing data to provide printed documents based on said data, and an enclosing/inserting and franking stage, characterized in that the franking of the cover is optimized by recto-verso printing the documents at will in case a value related to the weight of said documents exceeds postal threshold.

The said value can be the computed value of the said documents if recto-verso printed and/or if printed only recto, said value being obtained on the basis of the number of pages to be printed and of the weight of these pages. Such a value serves to measure the extent of a recto-verso passage.

In an advantageous embodiment, the invention's method comprises a stage for selecting the optimization of the franking process and a stage for selecting the optimization of insertion of the documents, that is, a stage in which the recto-verso printing is selected if the number of pages to be inserted exceeds the insertion capacities of the insertion machine.

Additional characteristics and advantages of the invention are described in the following text concerning various embodiments of the invention and related illustrations. The illustrations are as follows:

DETAILED DESCRIPTION OF THE EMBODIMENTS

Figure 5:
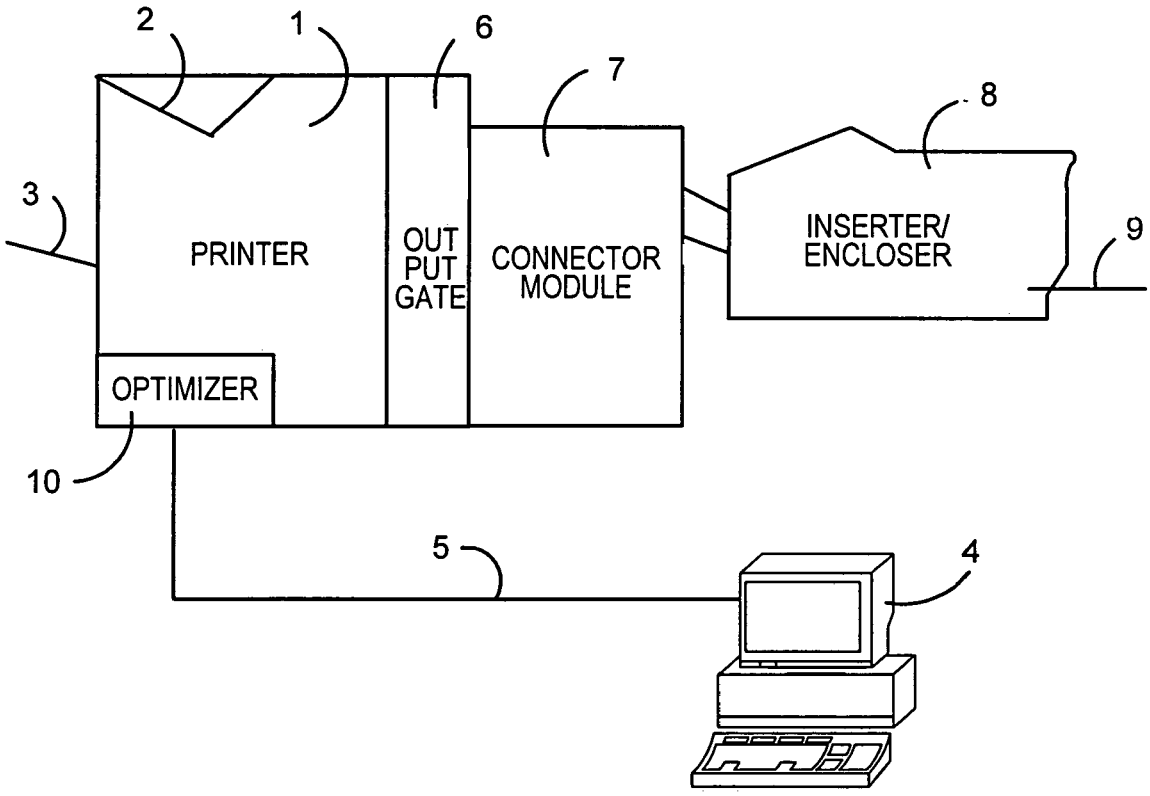

FIG. 5 shows a mail machine comprising an office-type printer 1, either laser, ink jet, or other, allowing only recto printing or recto-verso printing of A4 format documents and allowing the printing of envelopes without window. This printer includes, as known components, external feeders such as the sheet feeder 2 and the envelope feeder 3, as well as feeder storage units, not shown.

The printer 1 receives its data for printing from a computer 4 or from a network of computers or from an entirely different data provider with which it communicates by a cable 5 or by other means (radio, etc.) and prints a document that is outputted from output gate 6. The document is turned over to a connector module 7, for instance of the type described in patent application FR 2799690, and is then transmitted to the inserting/enclosing machine 8, in which it is folded and inserted into an envelope. The folded documents in envelopes emerge by output gate 9 and can be conveyed to a weighing and franking station.

The invention comprises an optimization means (10) upstream of the printer, that is, between the data provider and the printer.

Figure 1:
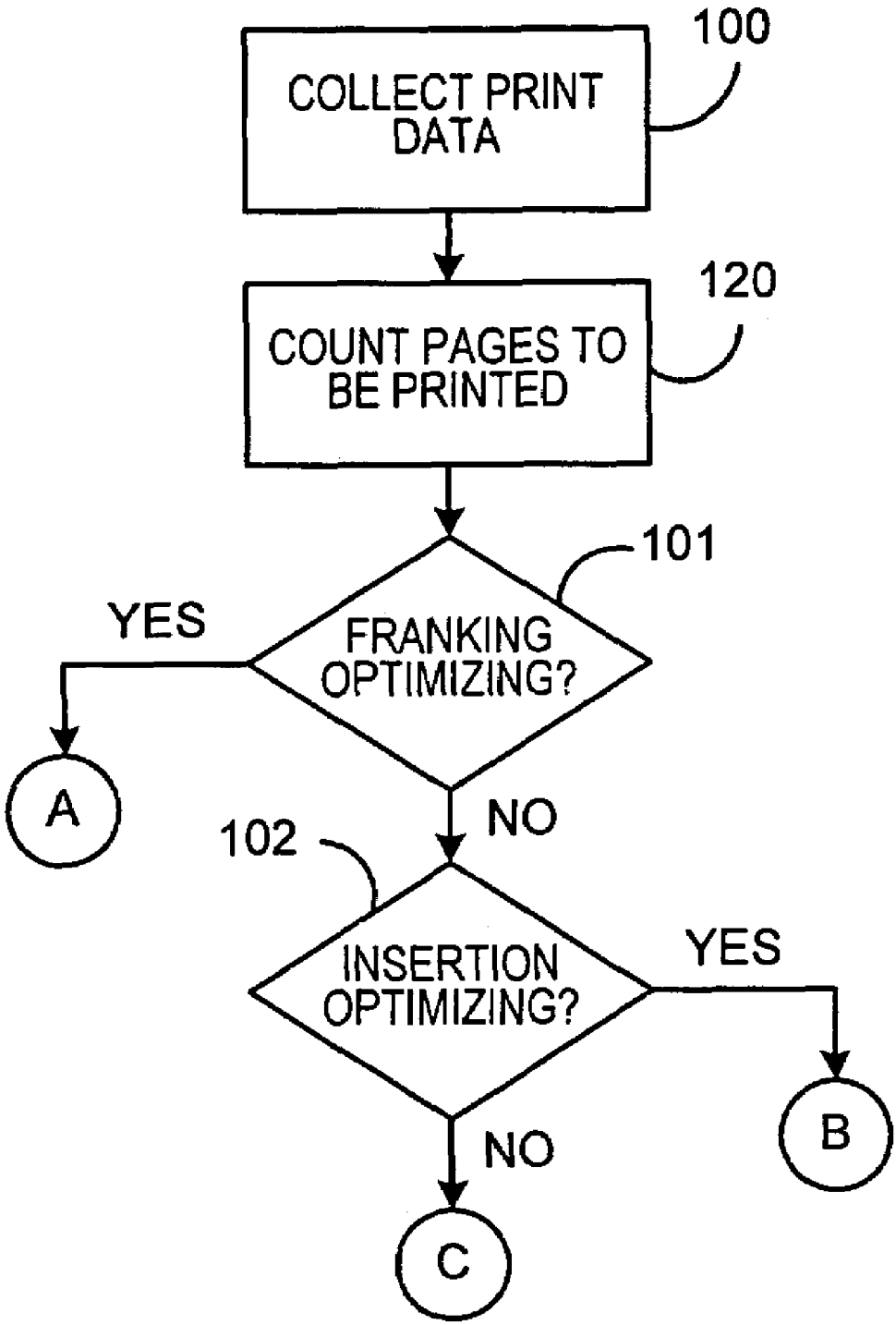
FIG. 1 General flow chart for the processing of mail in accordance with the invention FIGS. 2-4 Detailed view of three sub-processes A, B, C of the overall flow chart FIG. 5 Schematic view of an example of a mail processing machine in accordance with the invention

This optimization means performs optimization operations according to the flow chart in FIG. 1.

Figure 2:
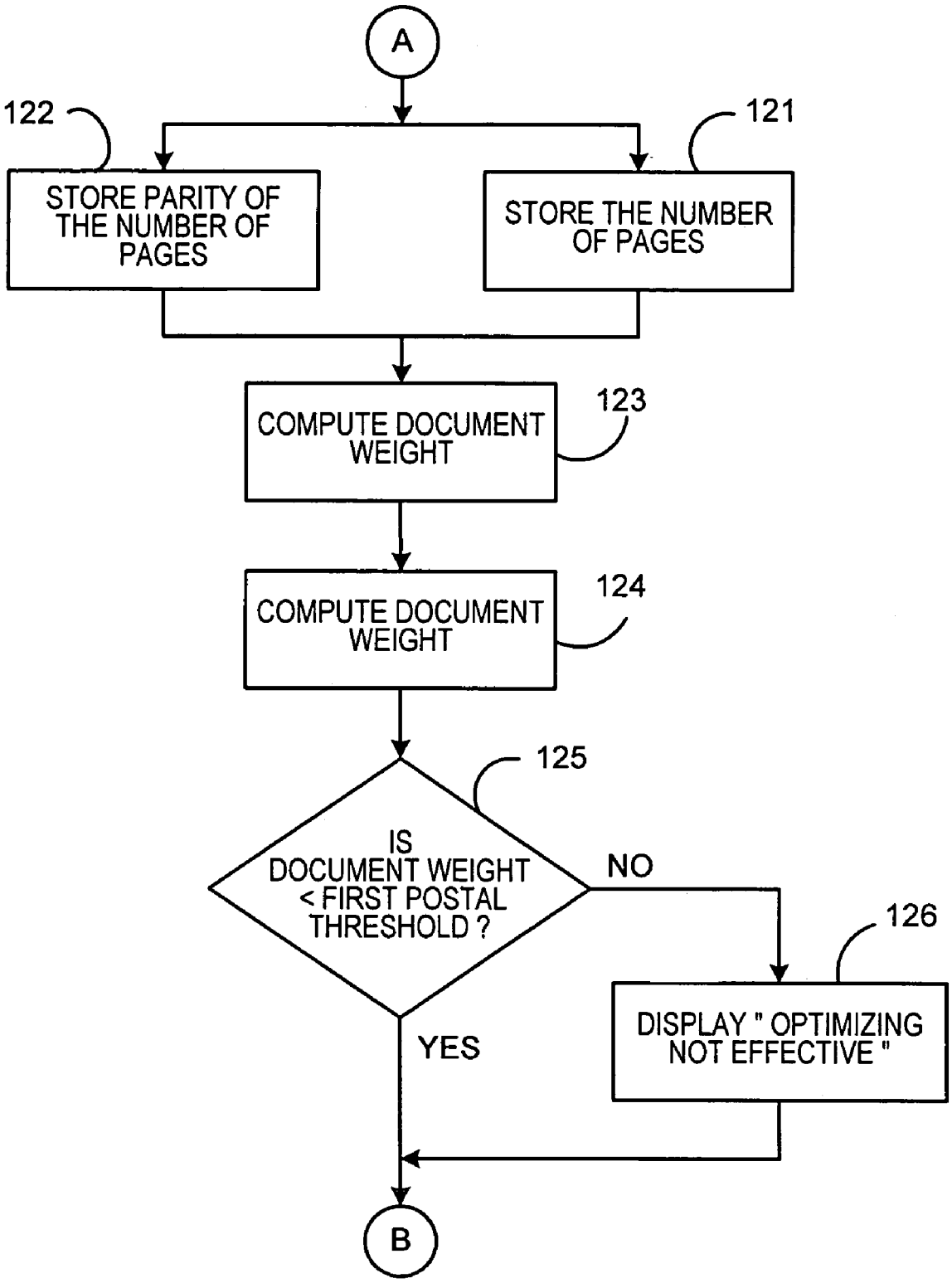
Figure 3:
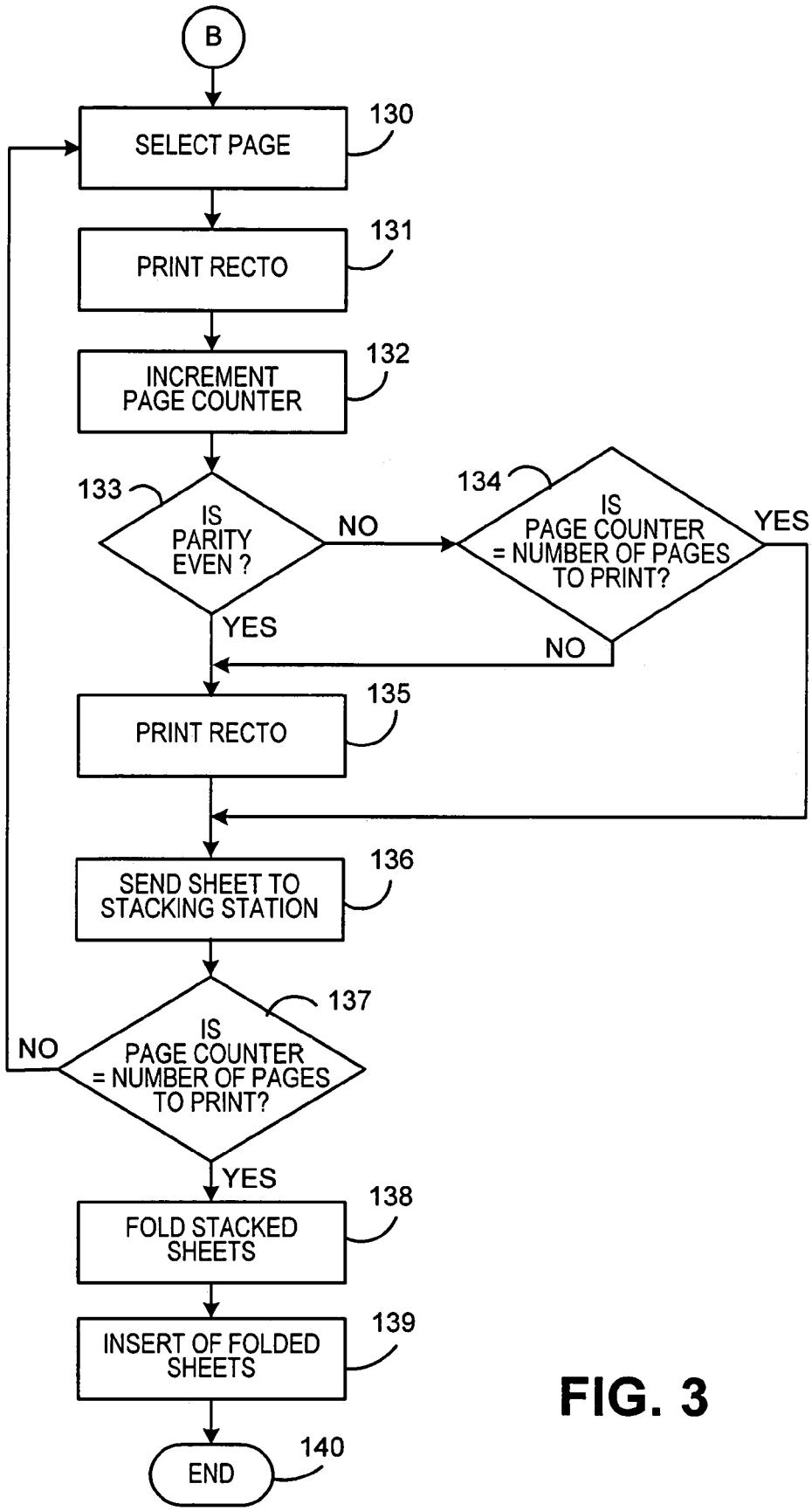
Figure 4:
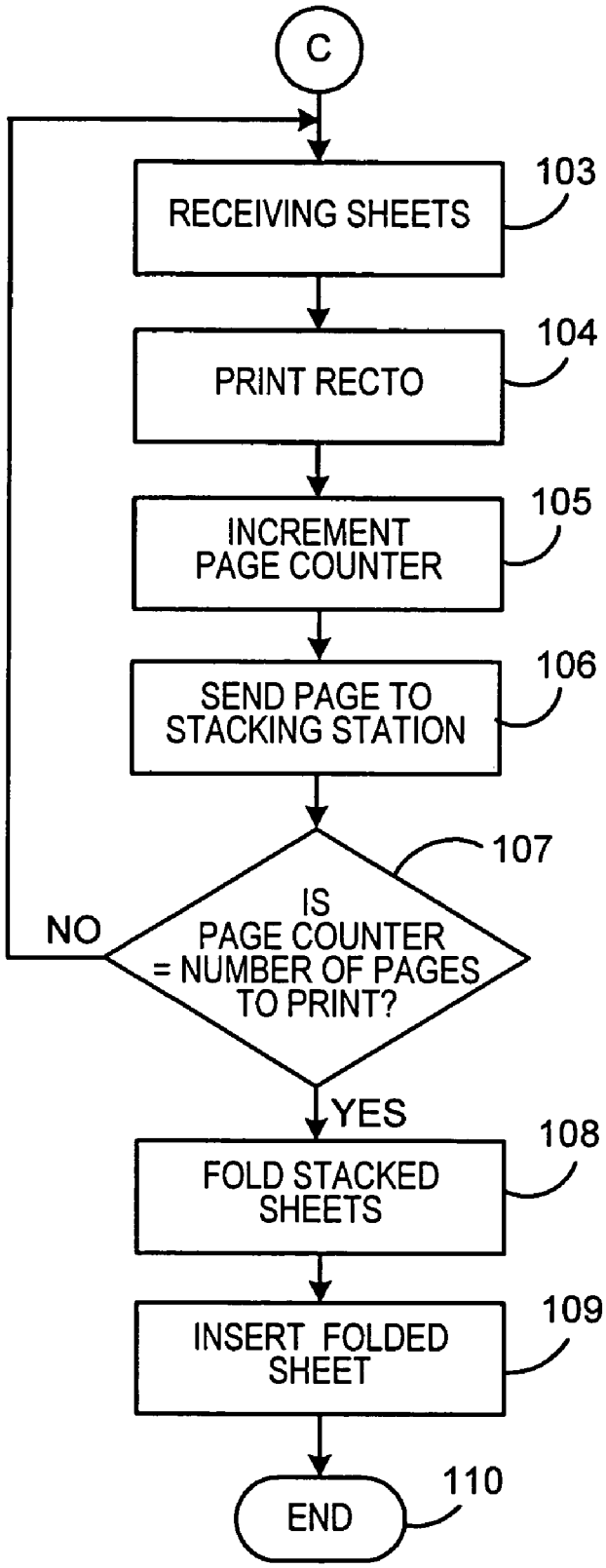

After reception of the data 100 and a preliminary count 120 of the pages to be printed, the software prompts the operator in step 101 to determine whether to optimize the franking. If the response is Yes, the software proceeds with program A according to the stages in FIG. 2. If the response is No, the software prompts concerning the optimization of insertion 102 (in order to reduce the number of pages to be inserted into an envelope, to take the maximum capacity of the inserter into account, for instance five sheets, that is, ten recto-verso printed pages). If the response is Yes, the software proceeds to program B according to the stages in FIG. 3. If the response is No, the software proceeds to the standard insertion treatment by program C according to the stages in FIG. 4.

Program C comprises the stages of, receiving the sheet 103, recto printing 104, increment of the sheet counter 105, and directing the sheet to the stacking station. Thereafter, a test 107 compares the content of the sheet counter with the number of sheets to be printed; as long as the two values are not identical, this part of the program is conducted in a closed circuit. As soon as they are identical, the software commands the insertion machine to execute the folding of the accumulated sheets 108 and the insertion of the folded sheets 109, which constitutes the end 110 of the standard program.

Subprogram A for optimizing the franking process comprises storage of the number of pages 121 as well as storage of the parity of the number of pages 122, then the computation of the weight of a sheet 123 based on a table or on data entered by the operator on the surface of the sheet (depending on standard formats A4, A5, etc.) or on the surface weight (grams per square meter, g/m2) of the paper, then the computation of the possible weight of the documents 124 if printed recto-verso, according to the formula:

weight of a sheet=summation of [(number of pages+1)/2], then a comparative test 125 between the possible weight of the documents and the first postal threshold. If the weight of the documents is greater than this threshold, the software indicates in a stage 126 that the optimization is not effective and proceeds to B. If the weight is below, the program proceeds directly to B.

Page selection 130 is followed by the recto printing 131, the increment of the page counter 132, and by a test of parity 133. In the event of parity of the contents of the page counter, the system goes directly to the recto printing 135 and to the conveying of the recto-verso printed sheet to the stacking station 136. In the event of non-parity, in 134 the contents of the page counter are compared to the number of pages to be printed. In the event of inequality, the verso printing 136 is commanded, and then the recto-verso printed sheet is conveyed to the stacking station 136; in case of equality, it proceeds directly to stage 136. The following stage 137 compares the page counter to the number of pages to be printed. In the event of inequality of the page counter and the number of pages to be printed, the program is terminated by the stages of folding of the accumulated sheets 138, insertion of folded sheets 139, and end 140.

The invention claimed is:

1. A mail processing machine comprising a recto-verso printer adapted to receive data to be printed and to produce printed documents based on said data, said documents being designed to be enclosed in a cover and franked, wherein the printer is capable of recto-verso printing the documents and in that the processing machine comprises:

means for determining the weight of said documents;

means for determining if franking should be optimized, means for determining if a value related to the weight of said documents exceeds a postal threshold only if it is determined that franking should be optimized; and means upstream of the printer to select the process for franking the cover by recto-verso printing the documents at will based upon the postal threshold determination only if it is determined that franking should be optimized.

2. The machine according to claim 1, wherein the processing machine further comprises a connector module and an inserting or enclosing machine.

3. The machine according to claim 1, wherein, said means for determining the weight of said documents comprises a lookup table.

4. The machine according to claim 1, wherein, said means for determining the weight of said documents comprises means for receiving operator input associated with the weight of said documents.

5. The machine according to claim 4, wherein, means for receiving operator input associated with the weight of said documents is configured to receive an indication of a standard format value associated with the documents.

6. The machine according to claim 4, wherein, means for receiving operator input associated with the weight of said documents is configured to receive an indication of a surface weight of the documents.

7. A mail processing method comprising a stage for printing data to provide printed documents based on said data, and an enclosing/inserting stage for enclosing said documents in a cover and franking stage, determining whether franking should be optimized, determining the weight of said documents, determining if a value related to the weight of said documents exceeds a postal threshold only if it is determined that franking should be optimized;

recto-verso printing the documents at will based upon the postal threshold determination only if it is determined that franking should be optimized; and franking the cover.

8. The method according to claim 7, wherein the said value is the computed value of the said recto-verso printed documents.

9. The method according to claim 8 further comprising a stage for the selection of the process for franking, followed by a stage for the selection of print format for the insertion of the documents.

10. The method according to claim 7 further comprising a stage for the selection of the process for franking, followed by a stage for the selection of print format for the insertion of the documents.

11. The method according to claim 7, wherein, said step of determining the weight of said documents comprises looking up a value in a table.

12. The method according to claim 7, wherein, said step of determining the weight of said documents comprises receiving operator input associated with the weight of said documents.

13. The method according to claim 12, wherein, said step of receiving operator input associated with the weight of said documents further comprises receiving an indication of a standard format value associated with the documents.

14. The method according to claim 12, wherein, said step of receiving operator input associated with the weight of said documents further comprises receiving an indication of a surface weight of the documents.

15. A mail processing method including a stage for printing data to provide printed documents based on said data and an enclosing/inserting stage for enclosing said documents in a cover and franking stage comprising:

determining whether franking should be optimized, determining the weight of said documents, determining if a value related to the weight of said documents exceeds a postal threshold only if it is determined that franking should be optimized;

determining whether franking can be optimized based upon the determination of whether the value related to the weight of said documents exceeds the postal threshold;

if franking can be optimized, recto-verso printing the documents at will based upon the postal threshold determination only if it is determined that franking should be optimized;

if franking cannot be optimized, displaying a message indicating that franking cannot be optimized; and franking the cover.

16. The method according to claim 15, wherein, said step of determining the weight of said documents comprises looking up a value in a table.

17. The method according to claim 15, wherein, said step of determining the weight of said documents comprises receiving operator input associated with the weight of said documents.

18. The method according to claim 17, wherein, said step of receiving operator input associated with the weight of said documents further comprises receiving an indication of a standard format value associated with the documents.

19. The method according to claim 17, wherein, said step of receiving operator input associated with the weight of said documents further comprises receiving an indication of a surface weight of the documents.

* * * * *